US006418898B2

(12) United States Patent
Tanaka et al.

(10) Patent No.: US 6,418,898 B2
(45) Date of Patent: Jul. 16, 2002

(54) VALVE OPERATING SYSTEM IN INTERNAL COMBUSTION ENGINE

(75) Inventors: Chikara Tanaka; Hiromu Nakamura; Noriyuki Yamada, all of Wako; Junichi Iwamoto, Haga-gun, all of (JP)

(73) Assignee: Honda Giken Kogyo Kabushiki, Tokyo (JP)

( * ) Notice: Subject to any disclaimer, the term of this patent is extended or adjusted under 35 U.S.C. 154(b) by 0 days.

(21) Appl. No.: 09/745,992

(22) Filed: Dec. 26, 2000

(30) Foreign Application Priority Data

Dec. 27, 1999 (JP) ..... 11-370835

(51) Int. Cl.[7] ..... F01L 1/18

(52) U.S. Cl. ..... 123/90.4; 123/90.42; 123/90.44; 74/559

(58) Field of Search ..... 123/90.22, 90.39, 123/90.4, 90.41, 90.42, 90.44, 90.45, 90.47; 74/519, 559; 29/888.2

(56) References Cited

U.S. PATENT DOCUMENTS 5,259,346 A * 11/1993 Mills ..... 123/90.39
5,622,146 A * 4/1997 Speil ..... 123/90.22
5,908,015 A * 6/1999 Kreuter ..... 123/90.16
6,055,951 A * 5/2000 Rommer et al. ..... 123/90.22
6,237,552 B1 * 5/2001 Hoag, Jr. ..... 123/90.22

FOREIGN PATENT DOCUMENTS

JP 6-185322 7/1994

* cited by examiner

*Primary Examiner*—Weilun Lo
(74) *Attorney, Agent, or Firm*—Armstrong, Westerman & Hattori, LLP

(57) ABSTRACT

In a valve operating system in an internal combustion engine, a rocker arm has a plurality of valve abutments provided thereon and capable of being individually put into abutment against upper ends of a plurality of engine valves cam abutments, and also has cam abutments provided thereon to come into contact with a valve operating cam. Wall-removed portions are formed in the rocker arm at locations corresponding to the cam abutments and open at opposite sides of the rocker arm. Thus, it is possible to provide a reduction in weight of the rocker arm.

18 Claims, 11 Drawing Sheets

VALVE OPERATING SYSTEM IN INTERNAL COMBUSTION ENGINE

BACKGROUND OF THE INVENTION

1. Field of the Invention

The present invention relates to a valve operating system in an internal combustion engine comprising a swinging support section provided at a base end of a rocker arm and swingably carried on an arm support portion provided in a cylinder head, a plurality of valve abutments provided at a tip end of the rocker arm and capable of being individually put into abutment against upper ends of a plurality of engine valves, and cam abutments provided on the rocker arm in an intermediate portion thereof between the swinging support section and the valve abutments to come into contact with a valve operating cam.

2. Description of the Related Art

Such a valve operating system is conventionally known, for example, from Japanese Patent Application Laid-open No.6-185322.

In a valve operating system which is designed such that a plurality of engine valves are driven by a single rocker arm, the width of the rocker arm cannot help increasing, thereby bringing about increases in size and weight of the rocker arm. In the mentioned known system, however, a structure for reducing the weight of the rocker arm is not disclosed.

SUMMARY OF THE INVENTION

Accordingly, it is an object of the present invention to reduce the weight of the rocker arm for driving the plurality of engine valves.

To achieve the above object, according to a first aspect and feature of the present invention, there is provided a valve operating system in an internal combustion engine comprising a swinging support section provided at a base end of a rocker arm and swingably carried on an arm support portion provided in a cylinder head, a plurality of valve abutments provided at a tip end of the rocker arm and capable of being individually put into abutment against respective upper ends of a plurality of engine valves, and cam abutments provided on the rocker arm in an intermediate portion between the swinging support section and the respective valve abutments to come into contact with a valve operating cam, wherein the rocker arm has wall-removed portions formed therein at locations corresponding to the cam abutments, the wall-removed portions opening at opposite sides of the rocker arm.

With such arrangement of the first feature, the weight of the entire rocker arm can be reduced by the wall-reduced portions provided at the locations corresponding to the cam abutments.

According to a second aspect and feature of the present invention, in addition to the first feature, the rocker arm includes an opening in which a roller which is the cam abutment is accommodated, and a pair of coaxially disposed shaft insertion bores with its inner ends thereof opening into the opening and with its outer ends opening outwards and sideways of the rocker arm for fitting and fixing of opposite ends of a roller shaft for rotatably supporting the roller, the roller shaft being fitted and fixed in inner ends of the shaft insertion bores, with portions of the shaft insertion bores axially outer than the opposite ends of the roller shaft being left as the hollow wall-removed portions.

With the arrangement of the second feature, the portions of the shaft insertion bores axially outer than the opposite ends of the roller shaft are left as the hollow wall-removed portions, whereby the weight of the entire rocker arm can be reduced and moreover, the length of the roller shaft can be reduced. Thus, it is possible to facilitate the assembling of the roller shaft to the rocker arm and to make the roller shaft difficult to deform, thereby ensuring the proper swinging operation of the rocker arm.

According to a third aspect and feature of the present invention, in addition to the second feature, each of the shaft insertion bores comprises a first insertion bore portion adjacent to the opening, a second insertion bore portion connected at an inner end thereof to an outer end of the first insertion bore portion, and a step formed between the outer end of the first insertion bore portion and the inner end of the second insertion bore portion and facing on a side opposite to the opening, and the opposite ends of the roller shaft fitted respectively in the first insertion bore portions of the shaft insertion bores are disposed in caulked engagement with the step.

With such arrangement of the third feature, the size of each of the wall-removed portions of the shaft insertion bores left as the hollow form can be increased, thereby further reducing the weight of the entire rocker arm. Moreover, the roller shaft can be fixed to the rocker arm by caulking and hence, it is possible to further facilitate the assembling of the roller shaft to the rocker arm.

According to a fourth aspect and feature of the present invention, in addition to the second feature, the rocker arm has a pair of support walls provided thereon to extend from the swinging support section in such a manner that the valve abutments individually corresponding to the pair of engine valves are provided at tip ends of the support walls, and the opposite ends of the roller shaft formed at a length shorter than a distance between both of the support walls are fitted and fixed in the shaft insertion bores such that the wall-removed portions can be formed in the rocker arm at locations axially outer than the opposite ends of the roller shaft.

With the fourth feature, loads from the engine valves are applied to the support walls, but the roller can be supported by the roller shaft disposed at a location kept away from portions to which the loads are applied and hence, the rigidity of supporting of the roller can be enhanced.

According to a fifth aspect and feature of the present invention, in addition to the fourth feature, the rocker arm has a pair of cylindrical shaft support portions provided thereon over the first and second support walls and the opening to define the shaft insertion bores, respectively. With such arrangement of the fifth feature, the pair of the cylindrical shaft support portions interconnected through the roller shaft are connected to the support walls and hence, the rigidity of support walls and the rigidity of supporting of the roller can be enhanced.

According to the sixth aspect and feature of the present invention, in addition to any of the second to fourth features, each of portions of the shaft insertion bores left as the wall-removed portions is formed into such a shape that it is enlarged gradually as approaching the side of the rocker arm.

With such arrangement of the sixth feature, it is possible to facilitate an operation for fitting and fixing the roller shaft in the inner ends of the shaft insertion bores, leading to an enhanced assemblability.

According to the seventh aspect and feature of the present invention, in addition to the first feature, the rocker arm has a pair of support walls provided thereon to extend from the swinging support section in such a manner that the valve abutments are provided at tip ends of the support walls; a cam slipper which is the cam abutment is provided on the rocker arm between both of the support walls; and the wall-removed portions are formed within a pair of connecting tubes which interconnect the support walls and the cam slipper.

With the arrangement of the seventh feature, the cam slipper is continuously formed with the pair of support walls through the pair of the connecting tubes. Therefore, it is possible to reduce the weight of the rocker arm, while avoiding reductions in rigidity of the support walls and the rigidity of supporting of the cam slipper.

The above and other objects, features and advantages of the invention will become apparent from the following description of the preferred embodiments taken in conjunction with the accompanying drawings.

BRIEF DESCRIPTION OF THE DRAWINGS

FIG. 1 is a partially vertical sectional view of an internal combustion engine;

FIG. 2 is a plan view taken in a direction of an arrow 2 in FIG. 1;

FIG. 3 is a plan view of an exhaust-side rocker arm;

FIG. 4 is a sectional view taken along a line 4—4 in FIG. 2;

FIG. 5 is a sectional view taken along a line 5—5 in FIG. 2;

FIG. 6 is a sectional view taken along a line 6—6 in FIG. 5;

FIG. 7 is a sectional view taken along a line 7—7 in FIG. 6;

DESCRIPTION OF THE PREFERRED EMBODIMENTS

Figure 1:
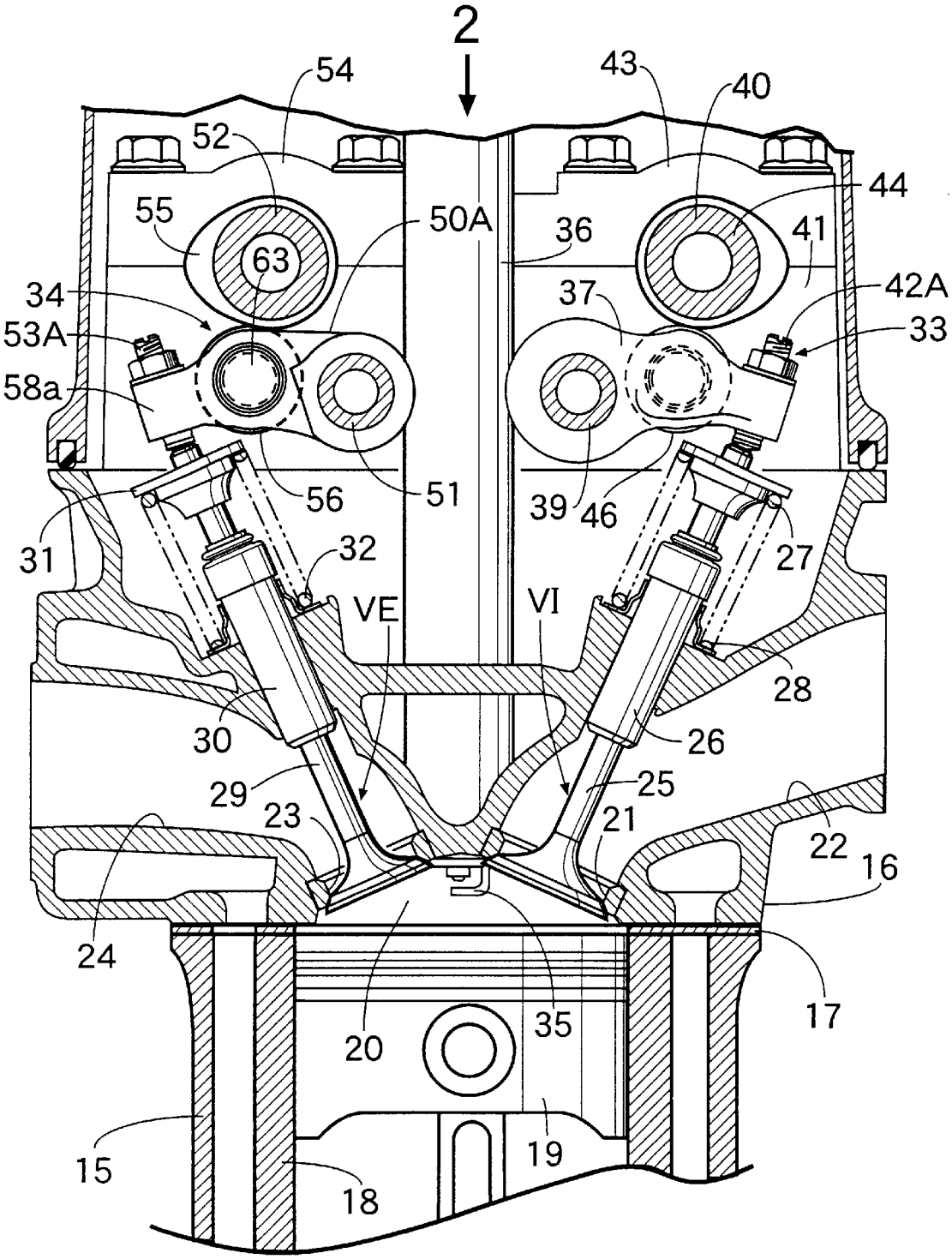
FIGS. 1 to 7 show a first embodiment of the present invention.
Figure 2:
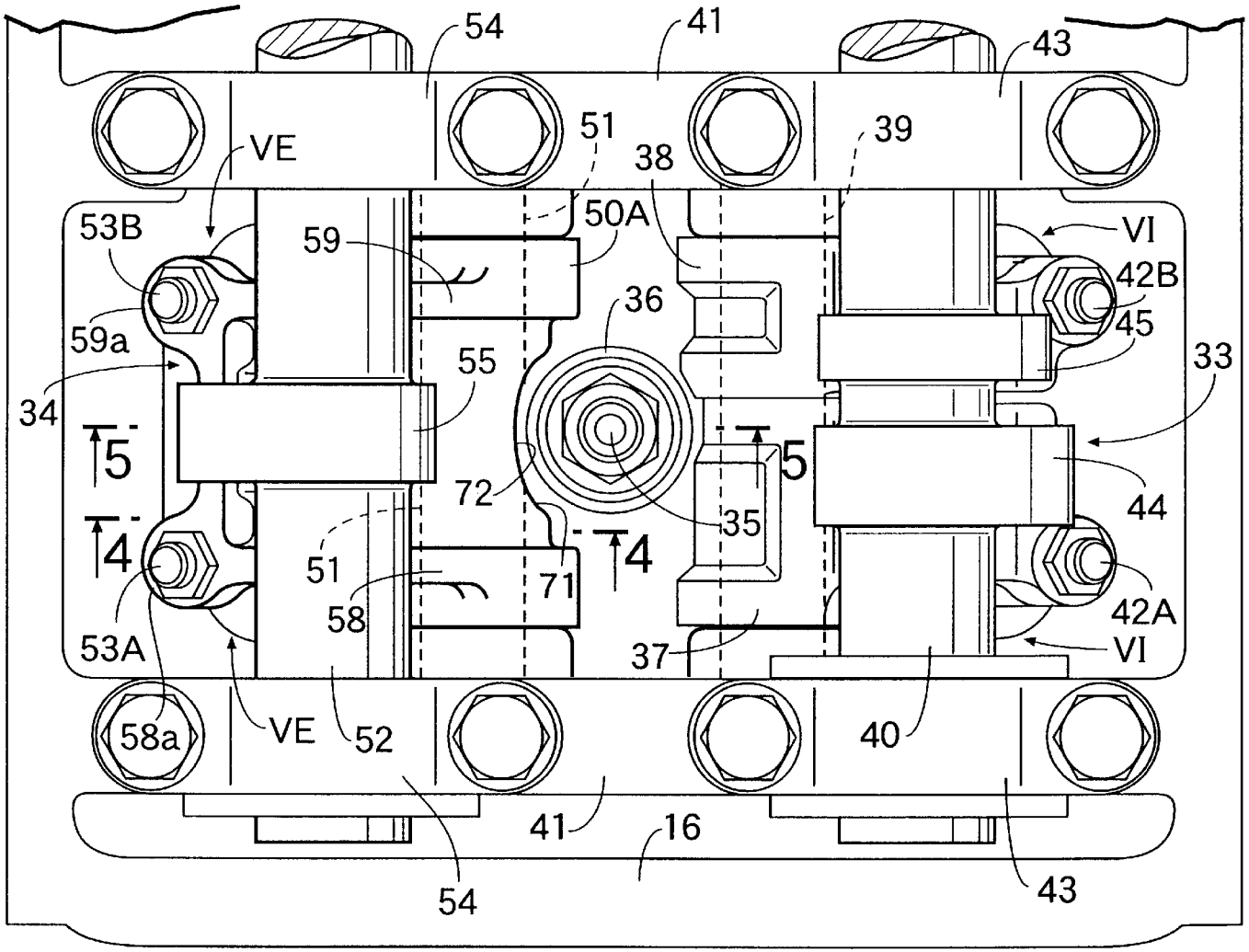

A first embodiment of the present invention will be described with reference to FIGS. 1 to 7. Referring first to FIGS. 1 and 2, a multi-cylinder internal combustion engine includes a cylinder block 15, and a cylinder head 16 coupled to an upper portion of the cylinder block 15 through a gasket 17. A piston 19 is slidably received in each of cylinders 18 provided in the cylinder block 15. A combustion chamber 20 is defined in each of the cylinders by the cylinder block 15, the cylinder head 16 and each of the pistons 19.

Provided in the cylinder head 16 for every cylinder are a pair of intake valve bores 21 facing one side of a ceiling surface of the combustion chamber 20, an intake port 22 which opens into one side (a right side in FIG. 1) of the cylinder head 16 and connected commonly to the intake valve bores 21, a pair of exhaust valve bores 23 facing the other side of the ceiling surface of the combustion chamber 20, and an exhaust port 24 which opens into the other side (a left side in FIG. 1) of the cylinder head 16.

Stems 25 of intake valves VI, VI capable of opening and closing the intake valve bores 21 are slidably received in guide tubes 26 mounted in the cylinder head 16, and valve springs 28 for biasing the intake valves VI, VI upwards, i.e., in valve closing directions are mounted between the cylinder head 16 and retainers 27, 27 mounted at upper ends of the stems 25 protruding upwards from the guide tubes 26. Stems 29 of exhaust valves VE, VE as engine valves capable of opening and closing the exhaust valve bores 23 are slidably received in guide tubes 30 mounted in the cylinder head 16, and valve springs 32 for biasing the exhaust valves VE, VE upwards, i.e., in valve closing directions are mounted between the cylinder head 16 and retainers 31, 31 mounted at upper ends of the stems 29 protruding upwards from the guide tubes 30.

The intake valves VI, VI are opened and closed by an intake-side valve operating device 33, and the exhaust valves VE, VE are opened and closed by an exhaust-side valve operating device 34. A plug insertion tube 36 is disposed to extend vertically, so that a spark plug 35 mounted in the cylinder head 16 to face a central portion of the combustion chamber 20 is inserted into the plug insertion tube 36. The plug insertion tube 36 is attached at its lower end to the cylinder head 16.

The intake-side valve operating device 33 includes a pair of intake-side rocker arms 37 and 38 individually corresponding to the pair of intake valves VI, VI, an intake-side rocker shaft 39 on which the intake-side rocker arms 37 and 38 are swingably carried, and an intake-side camshaft 40 which is rotatable about an axis parallel to the rocker shaft 39.

The intake-side rocker shaft 39 is fixedly supported by holder walls 41 provided on the cylinder head 16 between the cylinders, and intake-side rocker arms 37 and 38 are swingably carried at their base ends on the intake-side rocker shaft 39. Tappet screws 42A and 42B are threadedly fitted at tip ends of the intake-side rocker arms 37 and 38 to abut against upper ends of the corresponding intake valves VI, VI, i.e., upper ends of the stems 25, so that their advanced and retracted positions can be adjusted. The intake-side camshaft 40 is operatively connected at a reduction ratio of 1/2 to a crankshaft (not shown) and rotatably carried by the holder walls 41 and cam holders 43 fastened to upper ends of the holder walls 41.

The intake-side camshaft 40 is provided with a high-speed valve operating cam 44 corresponding to one of the intake-side rocker arms 37, and a low-speed valve operating cam 45 corresponding to the other intake-side rocker arm 38. A roller 46 supported on the one intake-side rocker arm 37 is in rolling contact with the high-speed valve operating cam 44, and a roller (not shown) supported on the other intake-side rocker arm 38 is in rolling contact with the low-speed valve operating cam 45.

Moreover, an interlocking-motion switchover means (not shown) is provided between the intake-side rocker arms 37 and 38 and capable of switching over the interlocking motion of the rocker arms 37 and 38 and the releasing of the interlocking motion one from another, so that the rocker arms 37 and 38 are swung independently from each other during operation of the engine at a low speed and the rocker arms 37 and 38 are swung operatively from each other in an interlocking motion during operation of the engine at a high speed. Therefore, during operation of the engine at the low speed, the one intake-side rocker arm 37 is swung to open and close one of the intake valves VI in an operational characteristic corresponding to a cam profile of the high-speed valve operating cam 44, while the other intake-side rocker arm 38 is swung to open and close the other intake valves VI in an operational characteristic corresponding to a cam profile of the low-speed valve operating cam 45. During operation of the engine at the high speed, both of the intake-side rocker arms 37 and 38 are swung to open and close the intake valves VI, VI in the operational characteristic corresponding to the high-speed valve operating cam 44.

The exhaust-side valve operating device 34 includes a single exhaust-side rocker arm 50A which is common to the pair of exhaust valves VE and VE, an exhaust-side rocker shaft 51 serving as an arm support portion on which the exhaust-side rocker arm 50A is swingably carried and an exhaust-side cam shaft 52 which is rotatable about an axis parallel to the rocker shaft 51.

The exhaust-side rocker shaft 51 has an axis parallel to the intake-side rocker shaft 39 and is fixedly supported by the holder wall 41, as is the intake-side rocker shaft 39. The exhaust-side rocker arm 50A is swingably carried at its base end on the exhaust-side rocker shaft 51, and first and second tappet screws 53A and 53B as valve abutments are threadedly fitted at tip ends of the exhaust-side rocker arm 50A to abut against upper ends of the corresponding exhaust valves VE, VE, i.e., upper ends of the stems 29, so that their advanced and retracted positions can be adjusted. The exhaust-side camshaft 52 is operatively connected at a reduction ratio of 1/2 to the crankshaft (not shown) rotatably carried by the holder walls 41 and cam holders 54 fastened to the upper ends of the holder walls 41.

A valve operating cam 55 is provided on the exhaust-side camshaft 52 in correspondence to the exhaust-side rocker arm 50A, and a roller 56 as a cam abutment axially supported on the exhaust-side rocker arm 50A is in rolling contact with the valve operating cam 55.

Figure 3:
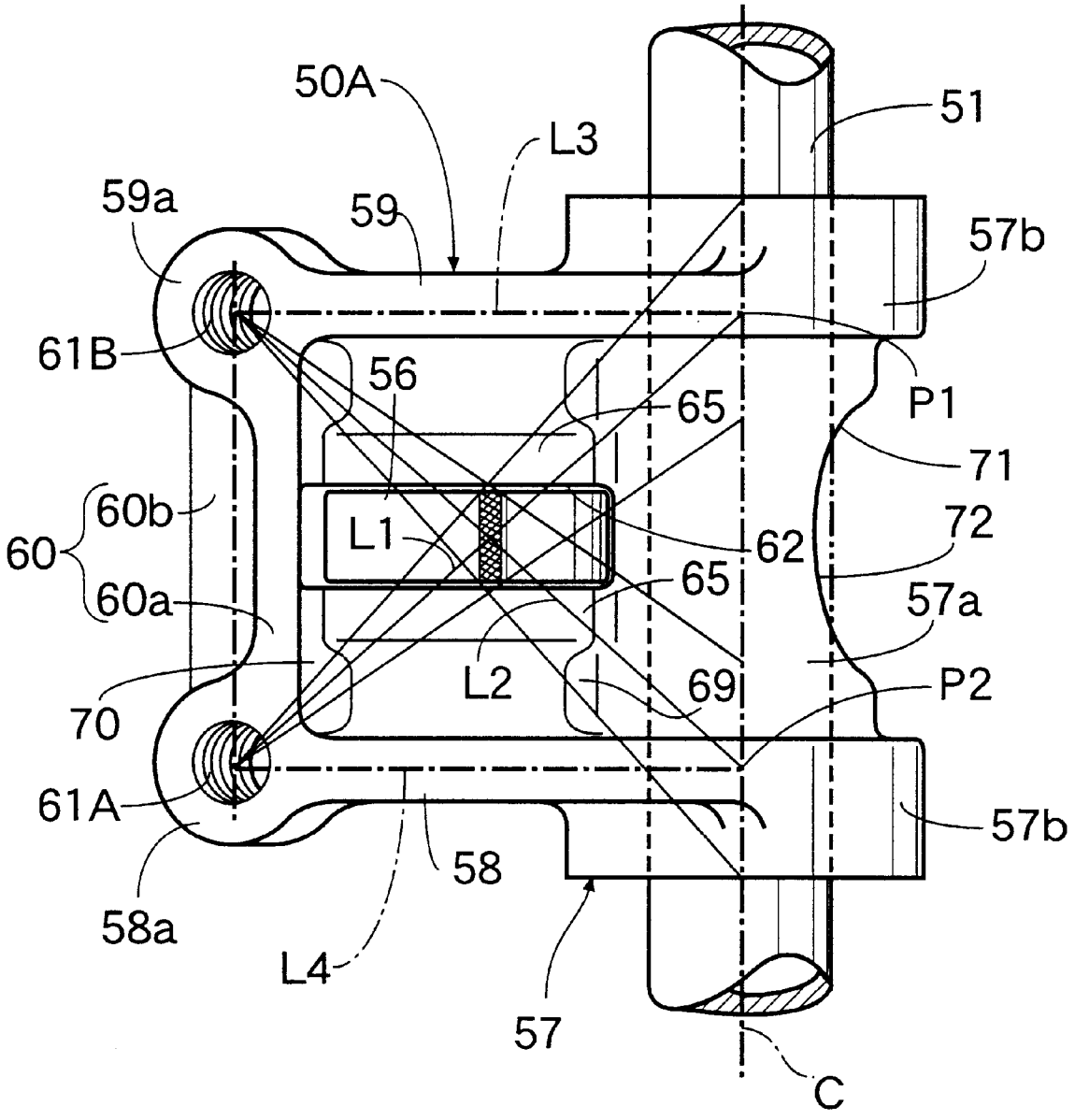

Referring to FIG. 3, the exhaust-side rocker arm 50A is provided at its base end with a cylindrical swinging support section 57 through which the exhaust-side rocker shaft 51 is inserted and which is swingably carried on the rocker shaft 51. The exhaust-side rocker arm 50A is further provided with first and second support walls 58 and 59, and a connection wall 60 connecting tip ends of the first and second support walls 58 and 59 to each other.

First and second boss portions 58*a* and 59*a* each having a circular outer peripheral surface are integrally formed on respective tip ends of the first and second support walls 58 and 59, so that they are arranged parallel to the axis of the exhaust-side rocker shaft 51. It is preferable that the first and second support walls 58 and 59 are provided to extend from opposite ends of the swinging support section 57 along a plane perpendicular to the axis of the exhaust-side rocker shaft 51, and that the first and second boss portions 58*a* and 59*a* and the swinging support section 57 are interconnected by the first and second support walls 58 and 59 perpendicular to the axis of the exhaust-side rocker shaft 51.

The boss portions 58*a* and 59*a* are provided with threaded bores 61A and 61B into which the first and second tappet screws 53A and 53B are threadedly engaged. The roller 56 is supported on the exhaust-side rocker arm 50A in a location intermediate between the swinging support section 57 and the tappet screws 53A and 53B, i.e., at a location displaced from the axis of the exhaust-side rocker shaft 51.

A first straight line L1 extends through (1) the center of one 53A of the first and second tappet screws 53A and 53B which is disposed on axially one side (a lower end side in FIG. 3) of the exhaust-side rocker shaft 51, i.e., the center of the threaded bore 61A in the first boss portion 58*a*, and (2) an area of contact (an area indicated by intersecting oblique lines in FIG. 3) of the valve operating cam 55 with the roller 56. A second straight line L2 extends through (1) the center of the other 53B of the first and second tappet screws 53A and 53B which is disposed on the axially other side (an upper end side in FIG. 3) of the exhaust-side rocker shaft 51, i.e., the center of the threaded bore 61B in the second boss portion 59*a*, and (2) an area of contact of the valve operating cam 55 with the roller 56. The first and second straight lines L1 and L2 and the axis C of the exhaust-side rocker shaft 51 intersect together at intersection points P1 and P2 as viewed in the plane of the exhaust-side rocker arm 50A. The intersection points P1 and P2 are disposed at locations inside axially opposite sides of the swinging support section 57. In other words, the swinging support section 57 is formed to have such a length that their opposite ends faces are disposed outside the first and second intersection points P1 and P2. It is desirable that the first and second straight lines L1 and L2 pass through the center of the area of contact of the valve operating cam 55 with the roller 56.

Moreover, the swinging support section 57 is formed at a length longer than a distance between the centers of the first and second tappet screws 53A and 53B, and third and fourth straight lines L3 and L4 passing through the centers of the first and second tappet screws 53A and 53B and intersecting the axis C of the exhaust-side rocker shaft 51 at right angles are disposed inside the axially opposite ends of the swinging support section 57.

Figure 4:
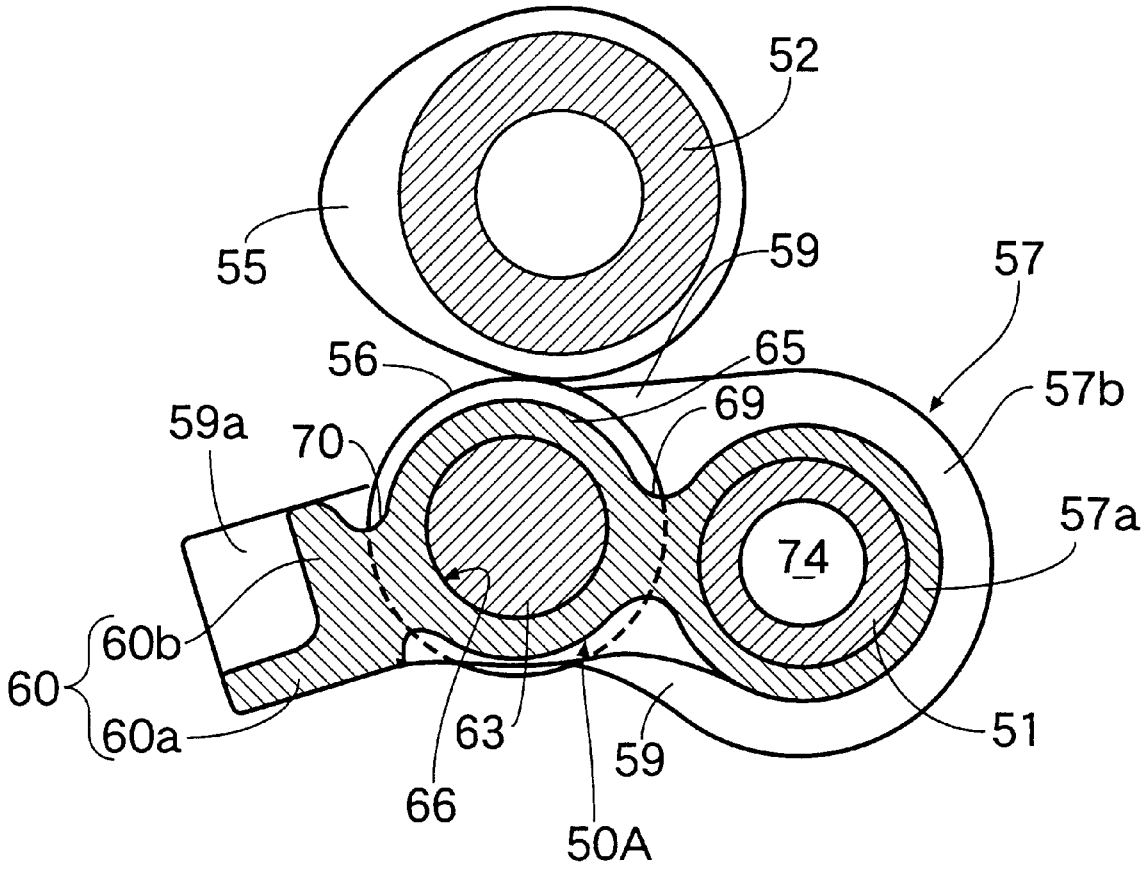
Figure 5:
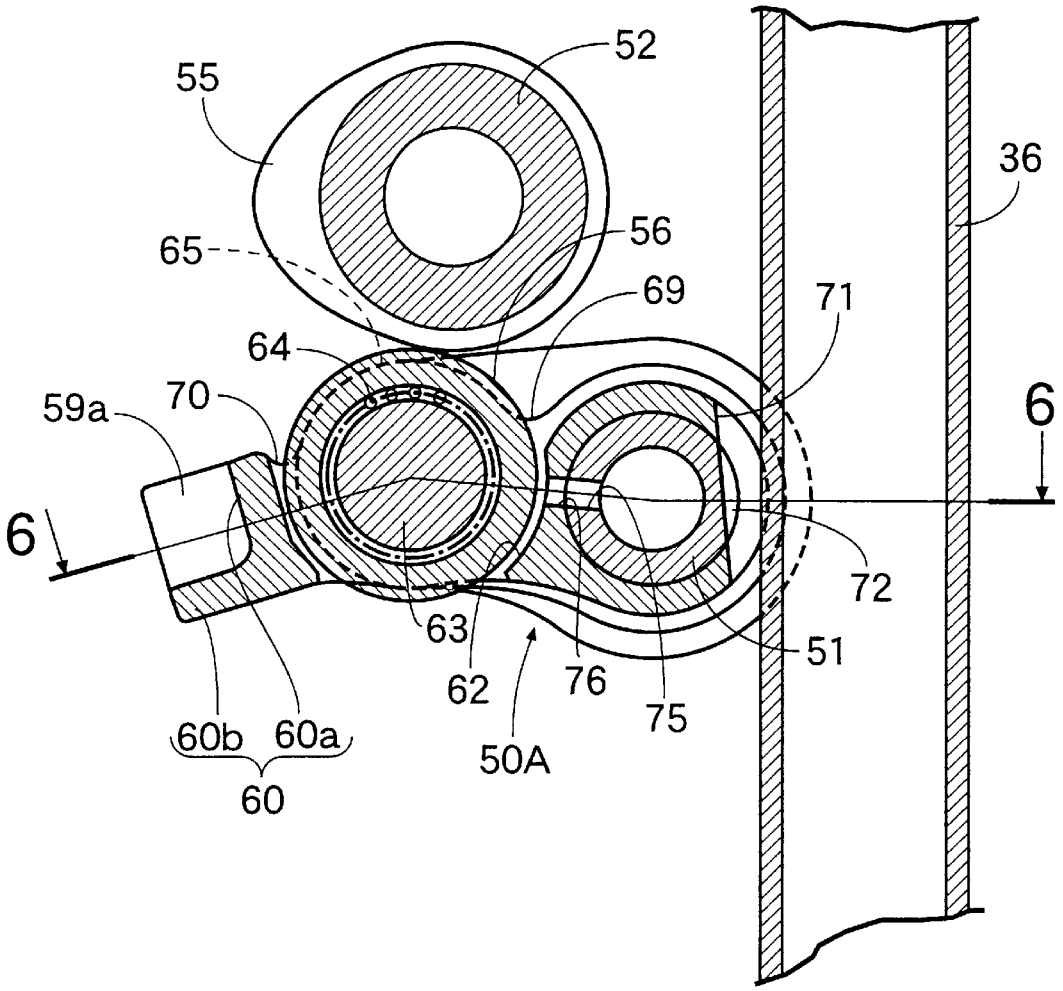
Figure 6:
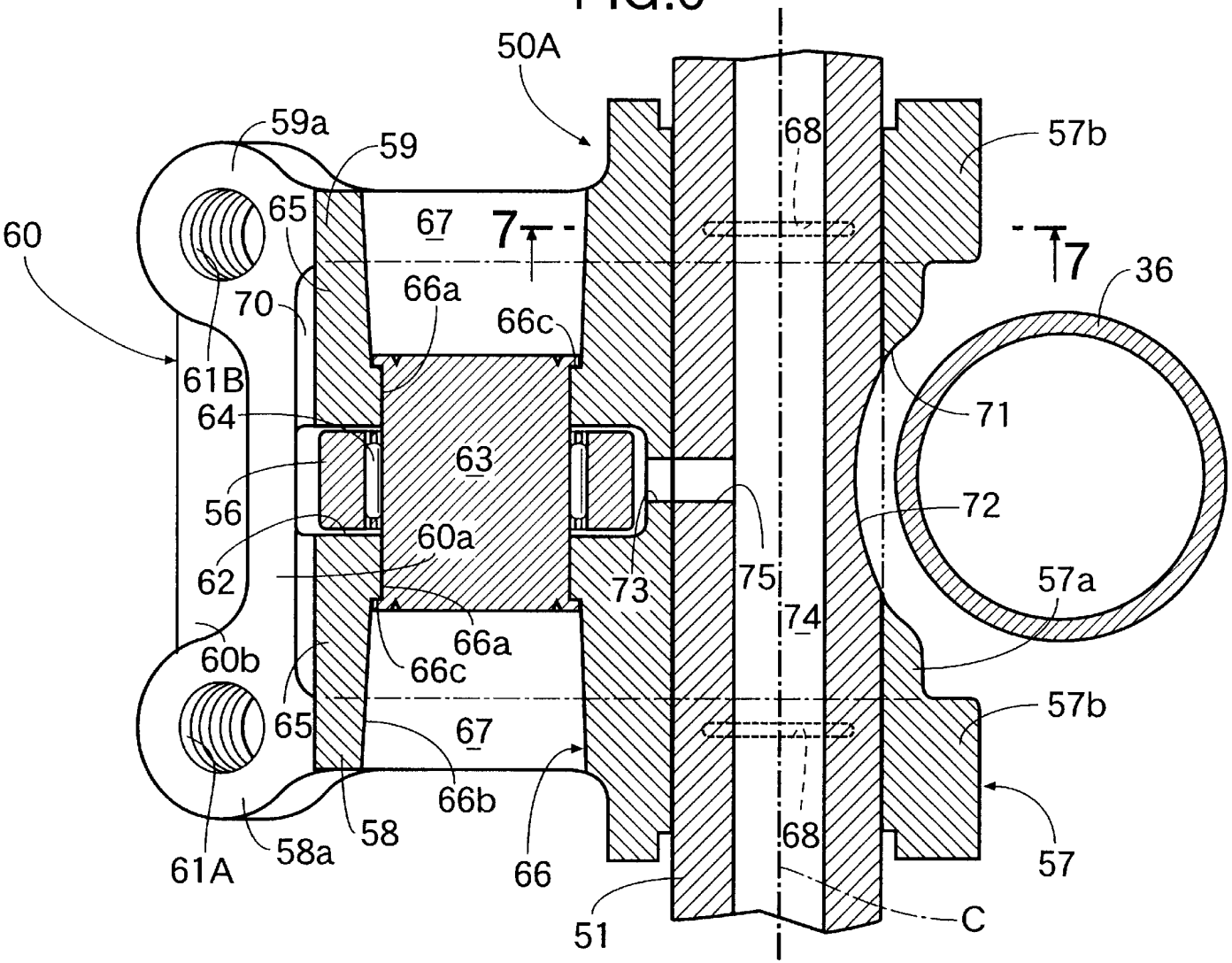

Referring also to FIGS. 4 to 6, a rectangular opening 62 for accommodation of the roller 56 is provided in the exhaust-side rocker arm 50A between the first and second support walls 58 and 59. A roller shaft 63, which has a length shorter than a distance between the first and second support walls 58 and 59 and has an axis parallel to the exhaust-side rocker shaft 51, extends across the opening 62 and is fixed to the exhaust rocker arm 50A, and the roller 56 is rotatably carried on the roller shaft 63 with a needle bearing 64 interposed therebetween.

A pair of shaft support portions 65, 65 which are formed into a cylindrical shape are provided over the first and second support walls 58 and 59 and the opening 62 respectively to extend in parallel to the exhaust-side rocker shaft 51. Shaft insertion bores 66, 66 are coaxially provided in the shaft support portions 65, 65, respectively, with its inner end opening into the opening 62 and with its outer end opening outwards and sideways of the exhaust-side rocker arm 50A, i.e., outwards and sideways of the first and second support walls 58, 59.

The shaft insertion bore 66 comprises a first insertion bore portion 66*a* adjacent the opening 62, a second insertion bore portion 66*b* connected at its inner end to an outer end of the first insertion bore portion 66*a*, and a step 66*c* formed between the outer end of the first insertion bore portion 66*a* and the inner end of the second insertion bore portion 66*b* and facing on a side opposite from the opening 62. It is desirable that the first and second insertion bore portions 66*a* and 66*b* are formed as coaxial circular bores, so that the annular step 66*c* is formed between both of the insertion bore portions 66*a* and 66*b*. If the first and second insertion bore portions 66*a* and 66*b* are formed as described above, it is easy to carry out a boring for forming them. Alternatively, the first insertion bore portion 66*a* may be circular in cross section, while the second insertion bore portion 66*b* may be non-circular in cross section. Namely, the second insertion bore portion 66*b* may be of any cross-sectional shape, if the step 66*c* is formed between the first and second insertion bore portions 66*a* and 66*b* to face on the side opposite from the opening 62. Moreover, it is desirable that the second insertion bore portion 66*b* is of such a shape that it is enlarged gradually as approaching a side of the exhaust-side rocker arm 50A. In the present embodiment, the second insertion bore portion 66*b* is defined as a tapered bore with its end adjacent to the exhaust-side rocker arm 50A being of a larger diameter.

The roller shaft 63 is fitted in and fixed to inner ends of the shaft insertion bores 66, 66 with each of portions of the shaft insertion bores 66 axially outer than opposite ends of the roller shaft 63 being left in a hollow form. For such fitting and fixing, outer peripheral edges of the opposite ends of the roller shaft 63 fitted in the first insertion bore portions 66*a*, 66*a* are brought into caulked engagement with the steps 66*c*, 66*c*. Thus, wall-removed portions 67, 67 are formed in the exhaust-side rocker arm 50A at locations axially outside the opposite ends of the roller shaft 63 in a state in which the roller shaft 63 has been fixed to the exhaust-side rocker arm 50A.

The cylindrical swinging support section 57 comprises a thinner cylindrical portion 57*a* surrounding the exhaust-side rocker shaft 51, and thicker cylindrical portions 57*b*, 57*b* thicker than the thinner cylindrical portion 57*a* and continuously and integrally formed at opposite ends of the thinner cylindrical portion 57*a*, respectively. The first and second support walls 58 and 59 are formed continuously with the thicker cylindrical portions 57*b*, 57*b*.

Figure 7:
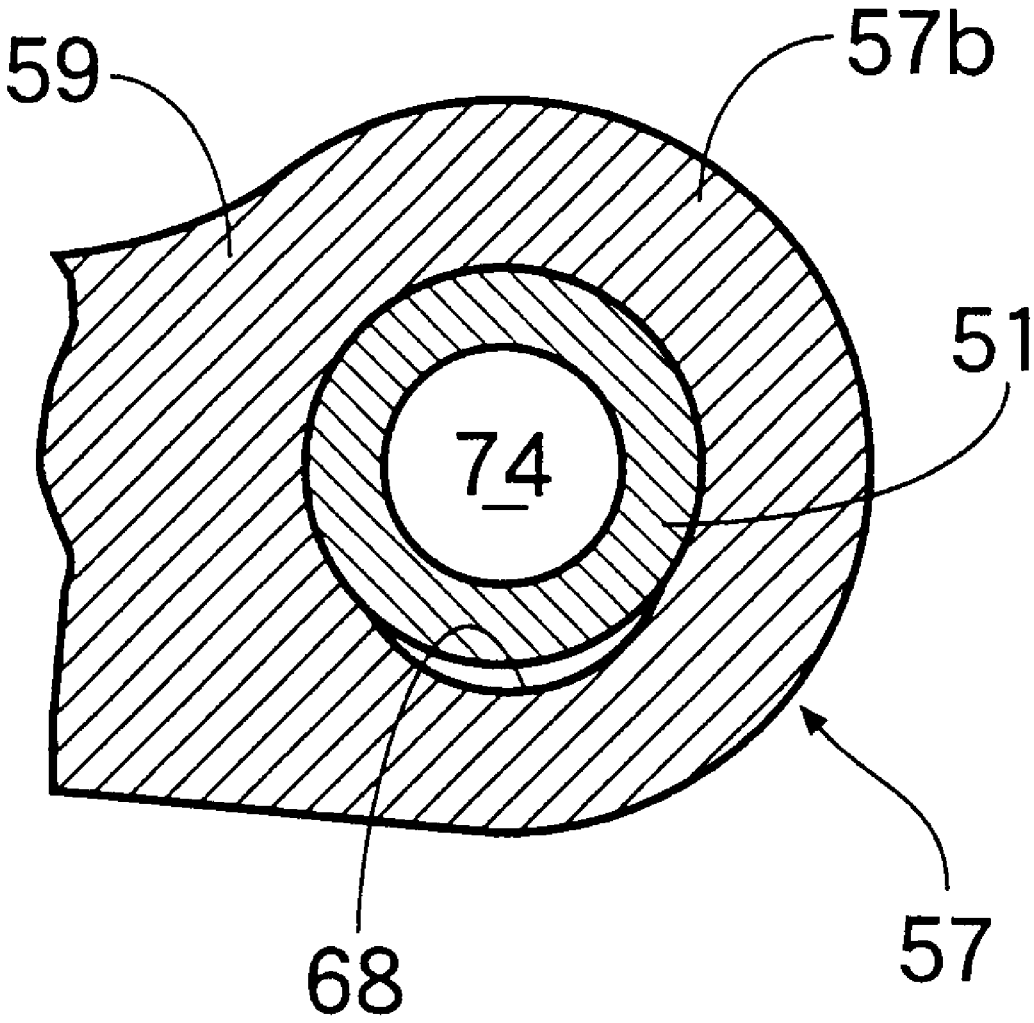

Referring also to FIG. 7, grooves 68, 68 capable of accumulation of an oil between the grooves and the outer surface of the exhaust-side rocker shaft 51 are provided in an arcuate shape in lower portions of inner surfaces of the thicker cylindrical portions 57*b*, 57*b* corresponding to connections of the first and second support walls 58 and 59, respectively.

Recesses 69 and 70 capable of supplying the oil to the roller 56 within the opening 62 are defined in portions of the upper surface of the exhaust-side rocker arm 50A, which are surrounded by the first and second support walls 58 and 59, the connection wall 60 and the swinging support section 57.

One of the recesses 69 is defined in the exhaust-side rocker arm 50A between the shaft support portions 65, 65 and the swinging support section 57, and the other recess 70 is defined in the exhaust-side rocker arm 50A between the shaft support portions 65, 65 and the connection wall 60.

An axially central portion of the swinging support section 57, i.e., an axially intermediate portion of the thinner cylindrical portion 57*a* is disposed at a location corresponding to the plug insertion tube 36. Notches 71 and 72 connected to each other are provided in the swinging support section 57 and the exhaust-side rocker shaft 51 at the location corresponding to the plug insertion tube 36 and formed into such an arcuate shape that they are recessed on a side opposite to the plug insertion tube 36, and a portion of the plug insertion tube 36 is accommodated in the notch 71. Moreover, the notches 71 and 72 are provided in the swinging support section 57 and the exhaust-side rocker shaft 51 between connections of the first and second support walls 58 and 59 to the swinging support section 57.

An oil injection bore 73 is provided, with its outer end opening into the opening 62, in the swinging support section 57 on a side opposite to the notch 71 with respect to the axis C of the exhaust-side rocker shaft 51. An oil supply passage 74 is provided in the exhaust-side rocker shaft 51 to extend along the axis C of the exhaust-side rocker shaft 51, and an oil supply bore 75 is also provided in the exhaust-side rocker shaft 51 to communicate with the oil supply passage 74, and is capable of communicating at its outer end with an inner end of the oil injection bore 73. The oil supply passage 74 is connected to an oil supply source which is not shown. Therefore, it is possible to supply the oil through the oil supply passage 74 within the exhaust-side rocker shaft 51 via the oil supply bore 75 and the oil injection bore 73 to the roller 56 to lubricate the roller 56. The communication between the oil supply bore 75 and the oil injection bore 73 may be cut off depending on a swung state of the exhaust-side rocker arm 50A, but in the cut-off state, the oil supplied from the oil supply bore 75 is used for the lubrication between the swinging support section 57 and the exhaust-side rocker shaft 51, and the oil is also supplied to the grooves 68, 68 in the inner surface of the swinging support section 57.

The connection wall 60 interconnecting the tip ends of the first and second support walls 58 and 59, i.e., the first and second boss portions 58*a* and 59*a* comprises first and second wall portions 60*a* and 60*b* intersecting each other at right angles in a plane perpendicular to the axis C of the exhaust-side rocker shaft 51, i.e., the swinging axis of the exhaust-side rocker arm 50A. The wall portions 60*a* and 60*b* intersect each other to form, for example, a substantially L-shape in such plane.

Moreover, the second wall portion 60*b* is formed to extend in parallel to the axis of the exhaust-side rocker shaft 51 with its outer surface connected flush to outer surfaces of the first and second boss portions 58*a* and 59*a* at their tip ends. One side of the opening 62 is defined by a portion of an inner surface of the first wall portion 60*a*.

The operation of the first embodiment will be described below. In the exhaust-side rocker arm 50A, the intersection points P1 and P2, at which (a) the first straight line L1 extending through (1) the center of one 53A of the first and second tappet screws 53A and 53B arranged in parallel to the axis C of the exhaust-side rocker shaft 51, which is disposed on the axially one side of the exhaust-side rocker shaft 51 and (2) the area of contact of the valve operating cam 55 with the roller 56, preferably the center of such area, (b) the second straight line L2 extending through (1) the center of the other 53B of the first and second tappet screws 53A and 53B which is disposed on the axially other side (an upper end side in FIG. 3) of the exhaust-side rocker shaft 51 and (2) the area of contact of the valve operating cam 55 with the roller 56, preferably the center of such area, and (c) the axis C of the exhaust-side rocker shaft 51 intersect together as viewed in the plane of the exhaust-side rocker arm 50A, are disposed inside the axially opposite ends of the cylindrical swinging support section 57 swingably carried on the exhaust-side rocker shaft 51.

Therefore, even if a difference is produced between the tappet clearances in the first and second tappet screws 53A and 53B, and a large load is produced on the first or second straight line L1, L2 to act so as to incline the exhaust-side rocker arm 50A, the exhaust-side rocker arm 50A can be supported stably, because the swinging support section 57 is supported on the exhaust-side rocker shaft 51 on the first and second straight lines L1 and L2. As a result, it is also possible to prevent an uneven wear from being produced in the swinging support section 57 and the roller 56.

In addition, the swinging support section 57 is formed at the length longer than the distance between the centers of the first and second tappet screws 53A and 53B, and the third and fourth straight lines L3 and L4 passing the centers of the first and second tappet screws 53A and 53B and intersecting the axis C of the exhaust-side rocker shaft 51 at the right angles are disposed inside the axially opposite ends of the swinging support section 57. Therefore, the exhaust-side rocker shaft 52 is supported on the exhaust-side rocker shaft 52 over the length longer than the distance between the tappet screws 53A and 53B, and the exhaust-side rocker arms 50A is supported more stably.

The roller shaft 63 is fitted and fixed in the exhaust-side rocker arm 50A, and the roller 56 in rolling contact with the valve operating cam 55 is rotatably carried on the roller shaft 63. However, the roller shaft 63 is shorter than the distance between the first and second support walls 58 and 59 provided to extend from the opposite ends of the swinging support section 57, and is fitted and fixed at the inner ends of the pair of shaft insertion bores 66, 66 which are coaxially provided in the exhaust-side rocker arm 50A with their portions axially outer than opposite ends of the roller shaft 63 being left as the hollow wall-removed portions 67, 67.

Thus, the portions of the shaft insertion bores 66 which are axially outer than the opposite ends of the roller shaft 63 are left in the hollow forms and hence, the weight of the entire exhaust-side rocker arm 50A can be reduced, and it is also possible to confirm, from the opposite sides of the exhaust-side rocker arm 50A, the state of the roller shaft 63 fixed to the rocker arm 50. Moreover, the roller shaft 63 can be formed at a relatively small length, whereby the assembling of the roller shaft 63 to the exhaust-side rocker arm 50A is facilitated. In addition, the roller shaft 63 can be formed so that it is difficult to deform, thereby ensuring a proper swinging movement of the exhaust-side rocker arm 50A. Loads from the exhaust valves VE, VE are applied to the first and second support walls 58 and 59, but the roller 56 can be supported by the roller shaft 63 disposed at the location kept away from the load-applied portions and hence, the rigidity of supporting of the roller 56 can be enhanced.

The shaft insertion bore 66 comprises the first insertion bore portion 66 adjacent to the opening 62 with the roller 56 accommodated therein, and the second insertion bore portion 66*b* connected at its inner end to the outer end of the first insertion bore portion 66 to form the step 66*c* facing on the side opposite from the opening 62 between the first and second insertion bore portions 66*a* and 66*b*. The opposite ends of the roller shaft 63 fitted in the first insertion bore portions 66*a*, 66*a* of the shaft insertion bores 66, 66 are in caulked engagement with the steps 66*c*, respectively, whereby the roller shaft 63 is fitted and fixed in the shaft insertion bores 66, 66. Therefore, the portions of the shaft insertion bores 66, 66 left in the hollow forms, i.e., the wall-removed portions 67, 67 can be formed at large areas as the second insertion bore portions 66*b*, 66*b*, and the weight of the entire exhaust-side rocker arm 50A can be further reduced. Further, since the roller shaft 63 is fixed in the caulked manner to the exhaust-side rocker arm 50A, the assembling of the roller shaft 63 to the exhaust-side rocker arm 50A is further facilitated.

Additionally, the portion of the shaft insertion bore 66 left as the wall-removed portion 67, i.e., the second insertion bore portion 66*b*, is of such shape that it is enlarged gradually as approaching the portion adjacent to the side of the exhaust-side rocker arm 50A. Therefore, an operation is facilitated for fitting and fixing the roller shaft 63 in the inner end of the shaft insertion bore 66, whereby the assemblability of the roller shaft can be enhanced.

Further, the pair of cylindrical shaft support portions 65, 65 defining the shaft insertion bores 66, 66 respectively are provided on the exhaust-side rocker arm 50A over the first and second support walls 58 and 59 and the opening 62, and the pair of cylindrical shaft support portions 65, 65 interconnected through the roller shaft 63 are connected to the support walls 58 and 59. Therefore, the rigidity of the support walls 58 and 59 and the rigidity of supporting of the roller 56 can be further enhanced.

The cylindrical swinging support section 57 provided at the base end of the exhaust-side rocker arm 50A so that it is swingably supported by the exhaust-side rocker shaft 51, comprises the thinner cylindrical portion 57*a* surrounding the exhaust-side rocker shaft 51, and the thicker cylindrical portions 57*b*, 57*b* thicker than the thinner cylindrical portion 57*a* surrounding the exhaust-side rocker shaft 51 and integrally connected to the axially opposite ends of the thinner cylindrical portion 57*a*, respectively. Therefore, the central portion of the swinging support section 57 can be formed at a smaller thickness to avoid an increase in weight of the exhaust-side rocker arm 50A, while the opposite ends of the swinging support section 57 having a possibility that a large load may be applied, can be formed at a larger thickness to enhance the rigidity of supporting of the exhaust-side rocker arm 50A and the durability of the latter.

In addition, the grooves 68, 68 capable of accumulation of an oil between the grooves and the outer surface of the exhaust-side rocker shaft 51 are provided in the inner surfaces of the opposite ends of the swinging support section 57 along the axis of the exhaust-side rocker shaft 51, i.e., in the inner surfaces of the thicker cylindrical portions 57*b*, 57*b*, respectively. Therefore, the oil can be accumulated between the opposite ends of the swinging support section 57 and the exhaust-side rocker shaft 51, and even if the exhaust-side rocker arm 50A is inclined, an uneven wear can be prevented to the utmost from being produced, leading to an enhanced durability. Moreover, the grooves 68, 68 are merely provided in the inner surface of the swinging support section 57 at its opposite ends and hence, the weight of the exhaust-side rocker arm 50A cannot be increased, and a reduction in rigidity of the swinging support section 57 can be inhibited.

Furthermore, the first and second support walls 58 and 59, at the tip ends of which the first and second tappet screws 53A and 53B are mounted to abut against the upper end of the exhaust valves VE, VE, are provided to extend from the opposite ends of the swinging support section 57 at the locations corresponding to the grooves 68, 68. Therefore, a slight reduction in rigidity of the opposite ends of the swinging support section 57 due to the provision of the grooves 68, 68 can be made up for by the first and second support walls 58 and 59.

The outer periphery of the exhaust-side rocker arm 50A is formed by the swinging support section 57, the first support wall 58, the second support wall 59 and the connection wall 60, and the recesses 69 and 70 are defined at least in the upper surface of the exhaust-side rocker arm 50A by the portions surrounded by the swinging support section 57, the first support wall 58, the second support wall 59 and the connection wall 60. Therefore, it is possible to provide a reduction in weight of the exhaust-side rocker arm 50A, while avoiding a reduction in rigidity of the exhaust-side rocker arm 50A.

Moreover, one of the recesses 69 is disposed between the pair of shaft support portions 65, 65 and the swinging support section 57, and the oil can be supplied to the roller 56 accommodated in the opening 62. Therefore, the oil scattered within the valve operating chamber can be reliably accumulated at a portion of the exhaust-side rocker arm 50A which is swung in a relatively small amount, thereby lubricating the roller 56, and hence, it is unnecessary to provide a passage for supplying the oil to the roller 56 in the exhaust-side rocker arm 50A, thereby reducing the number of steps of processing the exhaust-side rocker arm 50A.

The other recess 70 is defined in the exhaust-side rocker arm 50A between the shaft support portions 65, 65 and the connection wall 60 to enable the supplying of the oil to the roller 56 and hence, the weight of the tip end of the exhaust-side rocker arm 50A can be reduced to alleviate the inertial weight, while performing the lubrication of the roller 56.

The axially central portion of the swinging support section 57 in the exhaust-side rocker arm 50A is disposed at the location corresponding to the plug insertion tube 36 mounted in the cylinder head 16, and the notches 71 and 72 connected smoothly to each other and formed into the arcuate shape recessed on the side opposite to the plug insertion tube 36 are provided in the swinging support section 57 and the exhaust-side rocker shaft 51 at the location corresponding to the plug insertion tube 36. Therefore, it is possible not only to reduce the weight of the exhaust-side rocker arm 50A, but also the exhaust-side rocker shaft 51 and the plug insertion tube 36 can be disposed in the proximity to each other in such a manner that a portion of the plug insertion tube 36 is accommodated in the notch 71, and the limitation of the layout of the exhaust-side rocker arm 50A within the valve operating chamber can be moderated to contribute to the compactness of the entire engine.

Moreover, the notches 71 and 72 are provided in the swinging support section 57 and the exhaust-side rocker shaft 51 between the connections of the first and second support walls 58 and 59 to the swinging support section 57 and hence, the notches 71 and 72 can be disposed at the portions to which a relatively small stress is applied during driving of the exhaust valves VE, VE, thereby reducing the influence to the rigidity due to the provision of the notch 71 in the exhaust-side rocker arm 50A to reduce the weight of the exhaust-side rocker arm 50A.

The oil is supplied from the oil supply passage 74 in the exhaust-side rocker shaft 51 through the oil supply bore 75 and the oil injection bore 73 to the roller 56, and the oil injection bore 73 is provided in the swinging support section 57 on the side opposite to the notch 71, with respect to the axis C of the exhaust-side rocker shaft 51, which notch is provided in the swinging support section 57 in such a manner that an outer surface of a portion of the exhaust-side rocker shaft 71 provided with the notch 72 faces the notch 71. Therefore, it is possible to conduct a boring for the oil injection bore 73 from the side of the notch 71, thereby facilitating the boring for the oil injection bore 73.

The first and second boss portions 58*a* and 59*a*, in which the first and second tappet screws 53A and 53B are threadedly fitted to abut against the upper ends of the exhaust valves VE, VE, are disposed at the tip ends of the exhaust-side rocker arm 50A and arranged in the direction along the axis C of the exhaust-side rocker shaft 51, but they are interconnected by the connection wall 60. Therefore, the rigidity of the tip end of the exhaust-side rocker arm 50A driving the pair of exhaust valves VE, VE can be enhanced sufficiently and moreover, the connection wall 60 comprises the first and second wall portions 60*a* and 60*b* intersecting each other at the right angles in the plane perpendicular to the axis C of the exhaust-side rocker shaft 51, i.e., the swinging axis of the exhaust-side rocker arm 50A. Therefore, it is possible to suppress the increase in weight of the exhaust-side rocker arm 50A due to the connection wall 60 to the minimum, while maintaining the sufficient connection rigidity. In addition, the second wall portion 60*b* of the connection wall 60 is formed to extend in parallel to the axis of the exhaust-side rocker shaft 51, so that its outer surface is connected flush to the outer surfaces of the tip ends of the first and second boss portions 58*a* and 59*a*. Therefore, it is possible to eliminate the concentration of a stress on the connections between the connection wall 60 and the boss portions 58*a* and 59*a*, thereby enhancing the durability of the exhaust-side rocker arm 50A, while sufficiently enhancing the rigidity of the tip end of the exhaust-side rocker arm 50A.

Further, one side of the opening 62 provided in the exhaust-side rocker arm 50A to accommodate the roller 56 is formed by the inner surface of the first wall portion 60*a* of the connection wall 60, and the connection wall 60 can be disposed in proximity to the roller 56, thereby enhancing the rigidity of supporting of the roller 56.

Figure 8:
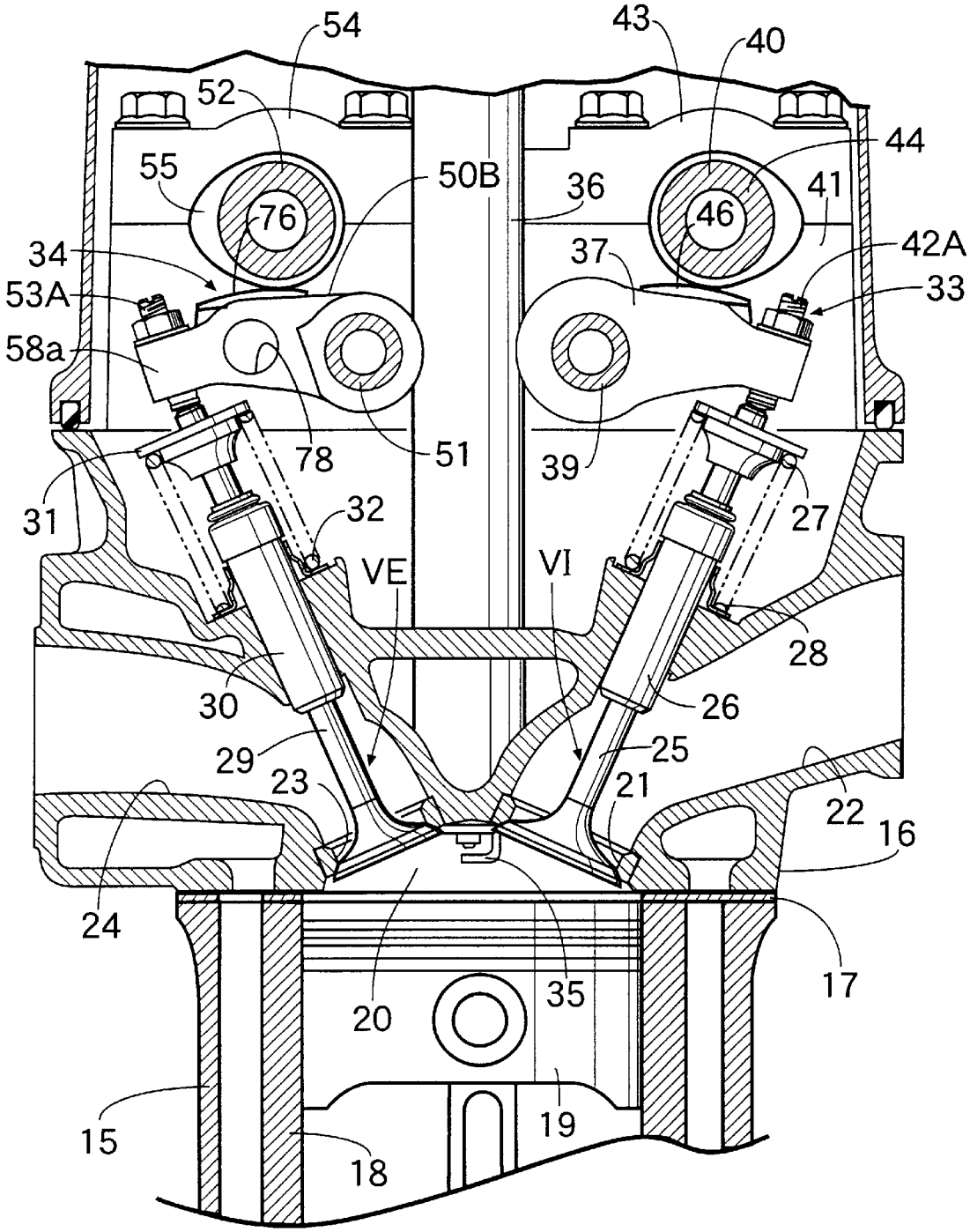
FIG. 8 is a partially vertical sectional view of an internal combustion engine, similar to FIG. 1, but according to a second embodiment of the present invention.
Figure 9:
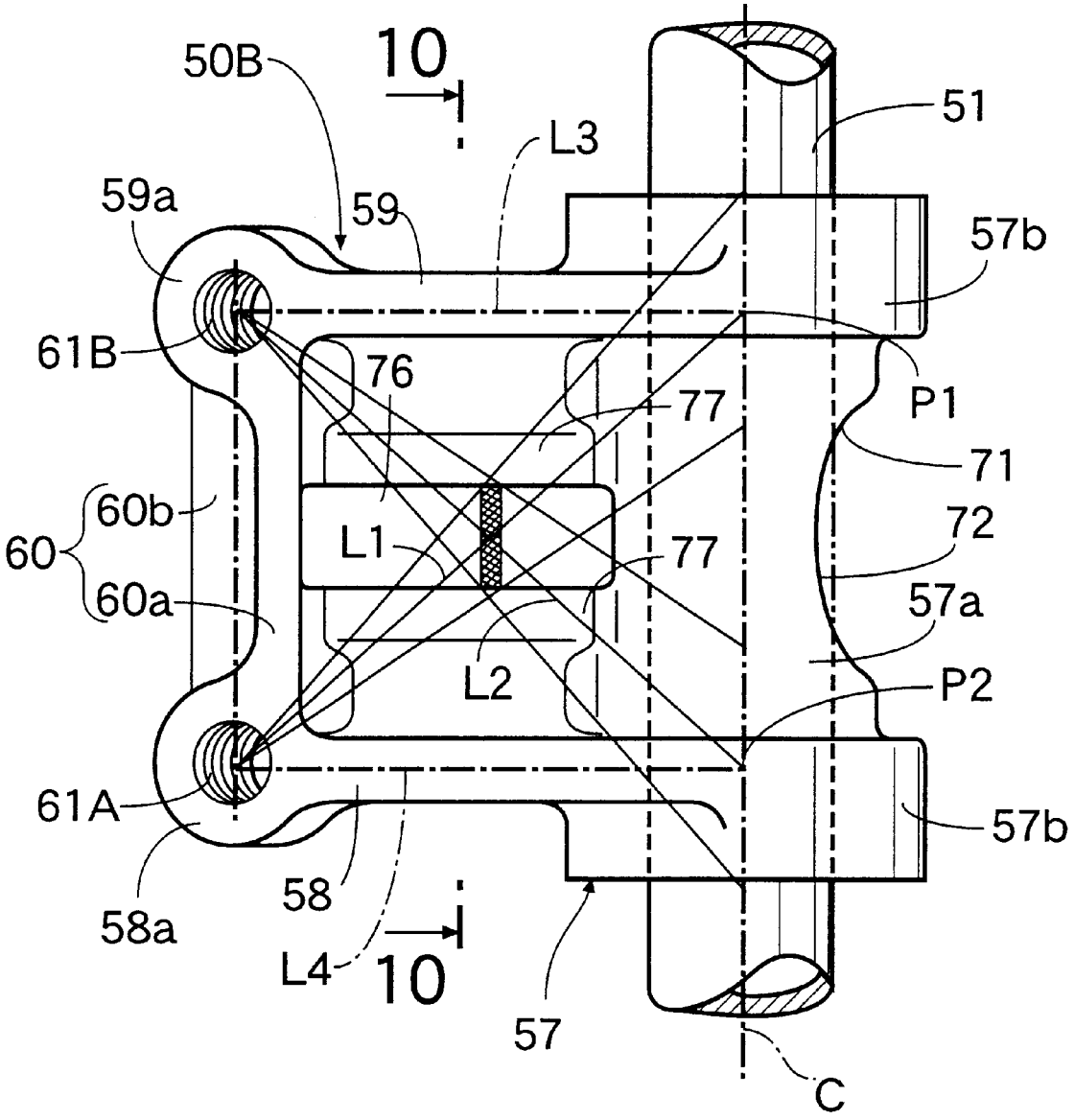
FIG. 9 is a plan view of an exhaust-side rocker arm, similar to FIG. 3, but according to the second embodiment.
Figure 10:
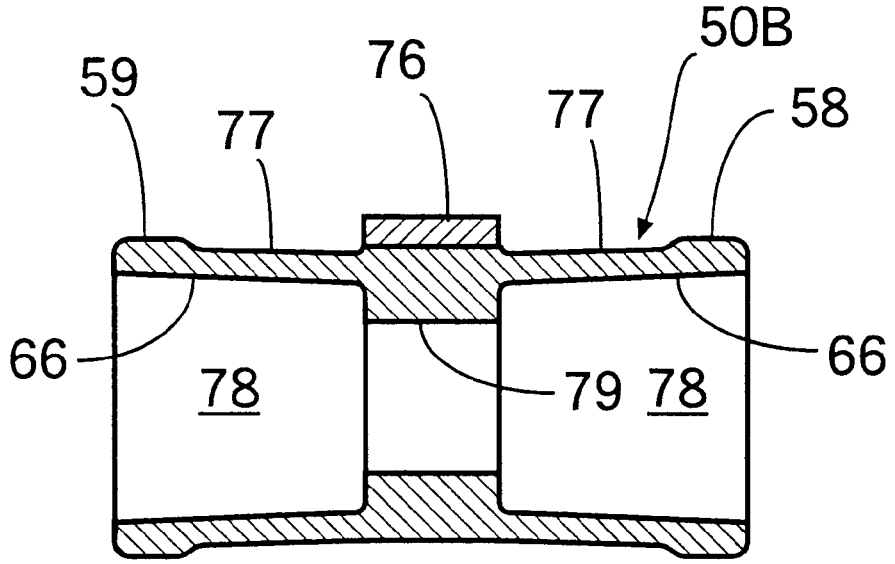
FIG. 10 is a sectional view taken along a line 10—10 in FIG. 9.

FIGS. 8 to 10 show a second embodiment of the present invention, wherein portions or components corresponding to those in the first embodiment are designated by like reference characters.

In the exhaust-side rocker arm 50B of the exhaust-side valve operating device 34, a cam slipper 76 as a cam abutment is provided integrally or by securing by another member, in an intermediate portion between the swinging support section 57 and the valve abutments 53A and 53B, and is in contact with the valve operating cam 55 on the exhaust-side camshaft 52.

The cam slipper 76 is disposed in an intermediate portion between the first and second support walls 58 and 59, and the support walls 58 and 59 and the cam slipper 76 are interconnected by connecting tubes 77, 77 extending in parallel to the exhaust-side rocker shaft 51. Moreover, a recess having a circular sectional shape is coaxially provided in each of the connecting tubes 77, 77 with its outer end opening into the outer surface of the exhaust-side rocker arm 50B, i.e., the outer surface of each of the first and second support walls 58 and 59. Thus, wall-removed portions 78, 78 are coaxially defined in the exhaust-side rocker arm 50B at locations corresponding to the cam slipper 76, and open into opposite sides of the exhaust-side rocker arm 50B, respectively. A through-bore 79 is provided in the exhaust-side rocker arm 50B at a location corresponding to the cam slipper 76 to coaxially connect inner ends of the wall-removed portions 78, 78 to each other, and is defined at a diameter smaller than those of the wall-removed portions 78, 78.

In the second embodiment, the wall-removed portions 78, 78 are formed in the exhaust-side rocker arm 50B at the locations corresponding to the cam slipper 76 provided in sliding contact with the valve operating cam 55, and open into the opposite sides of the exhaust-side rocker arm 50B, i.e., the sides of the first and second support walls 58 and 59, and therefore, the weight of the entire exhaust-side rocker arm 50B can be reduced.

Moreover, the wall-removed portions 78, 78 are defined within the connecting tubes 77, 77 interconnecting the cam slipper 76 and the first and second support walls 58 and 59. Therefore, it is possible to reduce the weight of the exhaust-side rocker arm 50B, while avoiding reductions in rigidity of the first and second support walls 58 and 59 and in rigidity of supporting of the cam slipper 76.

The weight of the exhaust-side rocker arm 50B can be reduced further by the interconnection of the wall-removed portions by the through-bore 79, and the reduction in wall thickness of the exhaust-side rocker arm 50B at the location corresponding to the cam slipper 76 can be suppressed to the minimum by defining the through-bore 79 disposed at the location corresponding to the cam slipper 76 at the diameter smaller than those of the wall-removed portions 78, 78 on the opposite sides of the through-bore 79, thereby inhibiting the reduction in rigidity of the exhaust-side rocker arm 50B at the location corresponding to the cam slipper 76.

Figure 11:
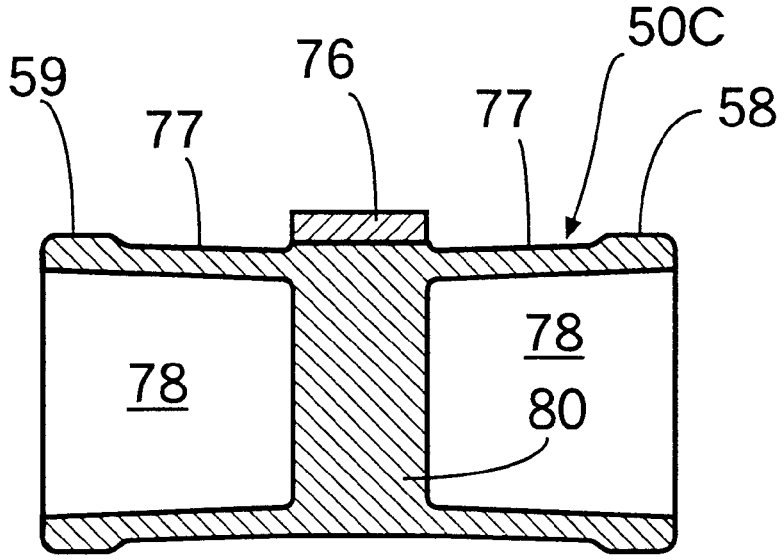
FIG. 11 is a sectional view similar to FIG. 10, but according to a third embodiment.

FIG. 11 shows a third embodiment of the present invention. In the third embodiment, inner ends of wall-removed portions 78, 78 may be spaced at a distance by a partition wall 80 from each other. If the wall-removed portions 78, 78 are formed in the above manner, the wall thickness of an exhaust-side rocker arm 50C can be increased at a location corresponding to the cam slipper 76, whereby the rigidity of the exhaust-side rocker arm 50C at the location corresponding to the cam slipper 76 can be maintained.

Figure 12:
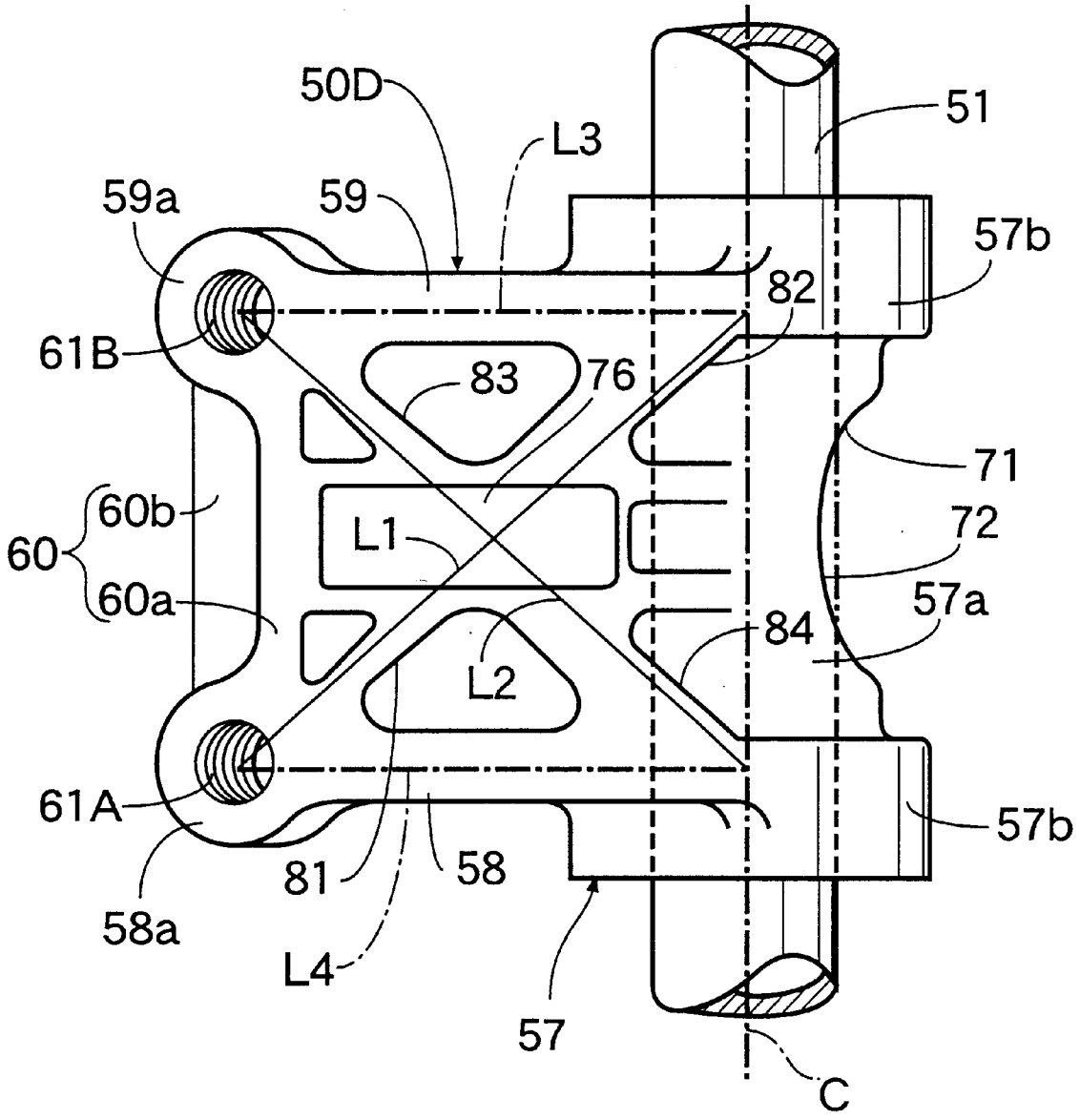
FIG. 12 is a plan view of an exhaust-side rocker arm, similar to FIG. 3, but according to a fourth embodiment.

FIG. 12 shows a fourth embodiment of the present invention. In the fourth embodiment, reinforcing ribs 81 and 82 are provided on an exhaust-side rocker arm 50D with the cam slipper 76 sandwiched therebetween to extend a first straight line L1 passing through the center of the first tappet screw 53A, i.e., the center of the threaded bore 61A in the first boss portion 58*a* and the center of the cam slipper 76, and reinforcing ribs 83 and 84 are also provided on the exhaust-side rocker arm 50D with the cam slipper 76 sandwiched therebetween to extend a second straight line L2 passing through the center of the second tappet screw 53B, i.e., the center of the threaded bore 61B in the second boss portion 59*a* and the center of the cam slipper 76.

According to the fourth embodiment, it is possible to further enhance the rigidity of the exhaust-side rocker arm 50D, and it is also possible to further effectively prevent an uneven wear from being produced in the swinging support section 57 and the cam slipper 76.

Although the embodiments of the present invention have been described in detail, it will be understood that the present invention is not limited to the above-described embodiments, and various modifications in design may be made without departing from the spirit and scope of the invention defined in claims.

For example, the present invention is applicable to a valve operating system for an intake valve.

What is claimed is:

1. A valve operating system in an internal combustion engine comprising a swinging support section provided at a base end of a rocker arm and swingably carried on an arm support portion provided in a cylinder head, a plurality of valve abutments provided at a tip end of said rocker arm and capable of being individually put into abutment against respective upper ends of a plurality of engine valves, cam abutments provided on said rocker arm in an intermediate portion between said swinging support section and said respective valve abutments to come into contact with a valve operating cam, wherein said rocker arm has a wall-removed portion formed therein at a location corresponding to said cam abutments, said wall-removed portion opening at least at one of opposite sides of said rocker arm, and connecting wall portions which are disposed above and below said wall-removed portion, respectively and connect said swinging support section and said valve abutments, respectively.

2. A valve operating system in an internal combustion engine comprising a swinging support section provided at a base end of a rocker arm and swingably carried on an arm support portion provided in a cylinder head, a plurality of valve abutments provided at a tip end of said rocker arm and capable of being individually put into abutment against respective upper ends of a plurality of engine valves, and cam abutments provided on said rocker arm in an intermediate portion between said swinging support section and said respective valve abutments to come into contact with a valve operating cam, wherein said rocker arm has wall-removed portions formed therein at locations corresponding to said cam abutments, said wall-removed portions opening at opposite sides of said rocker arm; wherein said rocker arm includes an opening in which a roller which is said cam abutment is accommodated, and a pair of coaxially disposed shaft insertion bores with its inner ends thereof opening into said opening and with its outer ends thereof opening outwards and sideways of said rocker arm for fitting and fixing of opposite ends of a roller shaft for rotatably supporting said roller, said roller shaft being fitted and fixed in inner ends of said shaft insertion bores, with portions of said shaft insertion bores axially outer than the opposite ends of said roller shaft being left as the hollow wall-removed portions.

3. A valve operating system in an internal combustion engine according to claim 2, wherein each of said shaft insertion bores comprises a first insertion bore portion adjacent to said opening, a second insertion bore portion connected at an inner end thereof to an outer end of said first insertion bore portion, and a step formed between the outer end of said first insertion bore portion and the inner end of said second insertion bore portion and facing on a side opposite to said opening, and each of the opposite ends of said roller shaft fitted respectively in said first insertion bore portions of said shaft insertion bores is disposed in caulked engagement with said step.

4. A valve operating system in an internal combustion engine according to claim 2, wherein said rocker arm has a pair of support walls provided thereon to extend from said swinging support section in such a manner that said valve abutments individually corresponding to the pair of engine valves are provided at tip ends of the support walls, and the opposite ends of said roller shaft formed at a length shorter than a distance between both of said support walls are fitted and fixed in said shaft insertion bores such that said wall-removed portions can be formed in said rocker arm at locations axially outer than the opposite ends of said roller shaft.

5. A valve operating system in an internal combustion engine according to claim 4, wherein said rocker arm has a pair of cylindrical shaft support portions provided thereon over said first and second support walls and said opening to define said shaft insertion bores, respectively.

6. A valve operating system in an internal combustion engine according to any of claims 2 to 5, wherein each of portions of said shaft insertion bores left as the wall-removed portions is formed into such a shape that it is enlarged gradually as approaching the side of said rocker arm.

7. A valve operating system in an internal combustion engine according to claim 2, wherein said rocker arm has a pair of support walls provided thereon to extend from said swinging support section in such a manner that said valve abutments are provided at tip ends of said support walls; a cam slipper which is said cam abutment is provided on said rocker arm between both of said support walls; and said wall-removed portions are formed within a pair of connecting tubes which interconnect said support walls and said cam slipper.

8. A valve operating system in an internal combustion engine comprising a swinging support section provided at a base end of a rocker arm and swingably carried on an arm support portion provided in a cylinder head, a plurality of valve abutments provided at a tip end of said rocker arm and capable of being individually put into abutment against respective upper ends of a plurality of engine valves, cam abutments provided on said rocker arm in an intermediate portion between said swinging support section and said respective valve abutments to come into contact with a valve operating cam, wherein said rocker arm has wall-removed portions formed therein at locations corresponding to said cam abutments, said wall-removed portions opening at opposite sides of said rocker arm, and connecting wall portions which are disposed above and below said wall-removed portions, respectively and connect said swinging support section and said valve abutments, respectively.

9. A valve operating system in an internal combustion engine comprising a swinging support section provided at a base end of a rocker arm and swingably carried on an arm support portion provided in a cylinder head, a plurality of valve abutments provided at a tip end of said rocker arm and capable of being individually put into abutment against respective upper ends of a plurality of engine valves, and cam abutments provided on said rocker arm in an intermediate portion between said swinging support section and said respective valve abutments to come into contact with a valve operating cam, wherein said rocker arm has a wall-removed portion formed therein at a location corresponding to said cam abutments, said wall-removed portion opening at least at one of opposite sides of said rocker arm, wherein said rocker arm includes an opening in which a roller which is said cam abutment is accommodated, and a pair of coaxially disposed shaft insertion bores with its inner ends thereof opening into said opening and with its outer ends thereof opening outwards and sideways of said rocker arm for fitting and fixing of opposite ends of a roller shaft for rotatably supporting said roller, said roller shaft being fitted and fixed in inner ends of said shaft insertion bores, with a portion of one of said shaft insertion bores axially outer than the associated opposite end of said roller shaft being left as the hollow wall-removed portion.

10. A valve operating system in an internal combustion engine according to claim 2 or 9, wherein a pair of bosses are provided for supporting said valve abutments and said roller shaft has an axial length which is shorter than a distance between said bosses.

11. A valve operating system in an internal combustion engine according to claim 2 or 8, wherein said swinging support section includes a pair of thick-wall portions which are distanced from each other in an axial direction of said arm support portion and each of said wall-removed portions is formed to extend to a location axially inner than an inner end of the thick-wall portion on the same axial side.

12. A valve operating system in an internal combustion engine according to claim 1 or 9, wherein said swinging support section includes a pair of thick-wall portions which are distanced from each other in an axial direction of said arm support portion and said wall-removed portion is formed to extend to a location axially inner than an inner end of the thick-wall portion on the same axial side.

13. A valve operating system in an internal combustion engine according to claim 2, wherein each of said wall-removed portions is formed to extend in an axial direction of said arm support portion to a location axially inner than an inner end of the valve abutment located on the same axial side.

14. A valve operating system in an internal combustion engine according to claim 9, wherein said wall-removed portion is formed to extend in an axial direction of said arm support portion to a location axially inner than an inner end of the valve abutment located on the same axial side.

15. A valve operating system in an internal combustion engine according to claim 2, wherein a pair of bosses are provided for supporting said valve abutments and each of said wall-removed portions is formed to extend in an axial direction of said arm support portion to a location axially inner than an inner end of the boss located on the same side.

16. A valve operating system in an internal combustion engine according to claim 9, wherein a pair of bosses are provided for supporting said valve abutments and said wall-removed portion is formed to extend in an axial direction of said arm support portion to a location axially inner than an inner end of the boss located on the same side.

17. A valve operating system in an internal combustion engine according to claim 2 or 9, wherein said roller shaft has an axial length which is shorter than a distance between said valve abutments.

18. A valve operating system in an internal combustion engine according to claim 2 or 9, wherein said roller shaft has an axial length which is shorter than a distance between said thick-wall portions of said swinging support section.

* * * * *